US009664466B2

(12) United States Patent
Gryparis

(10) Patent No.: US 9,664,466 B2
(45) Date of Patent: May 30, 2017

(54) LOCK INTERFACE INSERT FOR BOLT ASSEMBLY OF A FIREARM

(71) Applicant: Christ Stratis Gryparis, Farmington Hills, MI (US)

(72) Inventor: Christ Stratis Gryparis, Farmington Hills, MI (US)

( * ) Notice: Subject to any disclaimer, the term of this patent is extended or adjusted under 35 U.S.C. 154(b) by 0 days.

(21) Appl. No.: 15/244,496

(22) Filed: Aug. 23, 2016

(65) Prior Publication Data

US 2016/0356563 A1 Dec. 8, 2016

Related U.S. Application Data

(63) Continuation of application No. 14/865,013, filed on Sep. 25, 2015, now Pat. No. 9,423,193, which is a continuation of application No. 13/835,641, filed on Mar. 15, 2013, now Pat. No. 9,151,552.

(51) Int. Cl.

| | |
|---|---|
| ***F41A 3/00*** | (2006.01) |
| ***F41A 3/44*** | (2006.01) |
| ***F41A 3/12*** | (2006.01) |
| ***F41A 3/36*** | (2006.01) |
| ***F41A 5/08*** | (2006.01) |
| ***F41A 3/14*** | (2006.01) |
| ***F41F 1/00*** | (2006.01) |

(52) U.S. Cl.

CPC *F41A 3/44* (2013.01); *F41A 3/12* (2013.01); *F41A 3/14* (2013.01); *F41A 3/36* (2013.01); *F41A 5/08* (2013.01); *F41F 1/00* (2013.01)

(58) Field of Classification Search

CPC ..... F41A 3/12; F41A 3/36; F41A 3/44; F41A 3/08

USPC ..... 89/180, 187.01, 191.01; 42/16, 75.02

See application file for complete search history.

(56) References Cited

U.S. PATENT DOCUMENTS

| | | | | |
|---|---|---|---|---|
| 1,131,319 A | | 3/1915 | Blish | |
| 2,585,195 A | | 2/1952 | Walker | |
| 3,114,290 A | | 12/1963 | Harvey | |
| 3,635,123 A | | 1/1972 | Colby | |
| 3,848,510 A | | 11/1974 | Wolpert | |
| 3,938,423 A | | 2/1976 | Schertz | |
| 4,022,105 A | * | 5/1977 | White | F41A 3/26 89/149 |
| 4,213,261 A | | 7/1980 | Claypool | |
| 4,267,764 A | | 5/1981 | Yaniger | |
| 4,506,589 A | * | 3/1985 | Junker | F41A 3/40 89/190 |
| 4,677,898 A | | 7/1987 | Malhotra | |
| 4,742,757 A | * | 5/1988 | Matzagg | F41A 3/40 42/75.02 |
| 4,815,356 A | | 3/1989 | Hupp et al. | |

(Continued)

*Primary Examiner* — Michelle R Clement

(74) *Attorney, Agent, or Firm* — Carlson, Gaskey & Olds, P.C.

(57) ABSTRACT

A bolt for a firearm includes, among other things, a bolt body extending between a first bolt end and a second bolt end, the bolt body defining a shaped cavity adjacent to a breech lock recess. The shaped cavity is defined by a cavity floor extending between a forward cavity face and a rear cavity face, the forward cavity face defines a forward angle relative to the cavity floor, the rear cavity face defines a rear angle relative to the cavity floor, and each of the forward angle and the rear angle is acute. A bolt assembly for a firearm and a method of fabricating a bolt for a firearm are also disclosed.

19 Claims, 5 Drawing Sheets

(56) References Cited

U.S. PATENT DOCUMENTS

| | | | | |
|---|---|---|---|---|
| 4,974,356 | A | 12/1990 | Kelsey, Jr. | |
| 5,398,593 | A | 3/1995 | Sirkis | |
| 5,614,691 | A | 3/1997 | Taylor | |
| 5,675,106 | A | 10/1997 | Leiter | |
| 5,834,678 | A | 11/1998 | Kalb | |
| 6,044,748 | A | 4/2000 | Westrom | |
| 6,182,389 | B1 | 2/2001 | Lewis | |
| 6,276,252 | B1 | 8/2001 | Dionne | |
| 6,289,619 | B1 | 9/2001 | Fuchs | |
| 6,442,882 | B1 | 9/2002 | Dionne | |
| 6,609,319 | B1 | 8/2003 | Olson | |
| 6,742,434 | B1 * | 6/2004 | Dillon | F41A 3/26 42/16 |
| 6,820,533 | B2 | 11/2004 | Schuerman | |
| 6,907,813 | B2 * | 6/2005 | Gablowski | F41A 17/32 42/70.04 |
| 6,971,202 | B2 | 12/2005 | Bender | |
| 7,047,864 | B2 | 5/2006 | Spinner | |
| 7,237,469 | B2 | 7/2007 | Murello | |
| 7,287,456 | B2 | 10/2007 | Spielberger | |
| 7,721,639 | B2 | 5/2010 | Wossner | |
| 7,770,507 | B1 * | 8/2010 | Hajjar | F41A 3/46 89/188 |
| 8,230,632 | B2 | 7/2012 | Moretti | |
| 8,490,312 | B2 | 7/2013 | Barrett et al. | |
| 8,677,883 | B2 | 3/2014 | Wössner et al. | |
| 9,068,793 | B1 | 6/2015 | Barrett | |
| 9,377,257 | B2 * | 6/2016 | Foster | F41A 3/72 |
| 9,404,695 | B2 * | 8/2016 | Winge | F41A 5/26 |
| 2005/0188592 | A1 | 9/2005 | Spinner | |
| 2005/0217473 | A1 * | 10/2005 | Murello | F41A 5/24 89/187.01 |
| 2005/0223613 | A1 | 10/2005 | Bender | |
| 2005/0229772 | A1 | 10/2005 | Mayerl | |
| 2005/0257682 | A1 * | 11/2005 | Hajjar | F41A 3/46 89/188 |
| 2007/0012170 | A1 | 1/2007 | Spielberger | |
| 2009/0019755 | A1 | 1/2009 | Moretti | |
| 2010/0005956 | A1 | 1/2010 | Wossner | |
| 2010/0186581 | A1 * | 7/2010 | Hajjar | F41A 3/46 89/188 |
| 2010/0275491 | A1 | 11/2010 | Leiter | |
| 2012/0131835 | A1 | 5/2012 | Barrett et al. | |
| 2012/0216439 | A1 | 8/2012 | Barrett et al. | |
| 2013/0014416 | A1 | 1/2013 | Sisgold | |
| 2013/0047833 | A1 | 2/2013 | Steimke et al. | |
| 2013/0192114 | A1 | 8/2013 | Christenson | |
| 2015/0260470 | A1 * | 9/2015 | Foster | F41A 3/72 89/193 |
| 2015/0276338 | A1 | 10/2015 | Lewis | |

* cited by examiner

LOCK INTERFACE INSERT FOR BOLT ASSEMBLY OF A FIREARM

CROSS-REFERENCE TO RELATED APPLICATION

This disclosure is a continuation of U.S. patent application Ser. No. 14/865,013, filed Sep. 25, 2015, which is a continuation of U.S. patent application Ser. No. 13/835,641, filed Mar. 15, 2013.

BACKGROUND

This disclosure relates to short recoil weapons, and more particularly to the Browning M2 0.50 caliber (including all variants) and Browning 1919 0.30 caliber machine guns.

Short recoil weapons are generally configured to lock a bolt and a barrel together for a predetermined distance to ensure that energy produced by a fired cartridge is dissipated to a safe level prior to opening a breech. Prior to firing, a breech lock disposed in the barrel extension selectively engages a corresponding locking surface of the bolt (also described as the bolt lock interface), locking the bolt and barrel together. After the round is fired, the bolt, barrel extension and barrel travel together the predetermined distance. Then the breech lock disengages the bolt allowing the bolt to accelerate toward the rear of the receiver independently of the barrel.

While the bolt and the barrel are locked together and after the weapon is fired, a substantial portion of the recoil force is communicated to the locking surface of the bolt adjacent to the breech lock recess. Accordingly, a common wear point is the locking surface due to high cyclic rates of fire. After the amount of wear of the locking surface exceeds a predetermined wear threshold, the weapon may become dysfunctional or unsafe for use. Accordingly, even though only a small portion of the bolt is worn or distressed beyond allowable limits, the entire bolt is generally discarded.

SUMMARY

A bolt for a firearm according to an example of the present disclosure includes a bolt body extending between a first bolt end and a second bolt end. The bolt body defines a shaped cavity adjacent to a breech lock recess. The shaped cavity is defined by a cavity floor extending between a forward cavity face and a rear cavity face. The forward cavity face defines a forward angle relative to the cavity floor. The rear cavity face defines a rear angle relative to the cavity floor, and each of the forward angle and the rear angle is acute.

In a further embodiment of any of the foregoing embodiments, the shaped cavity is dimensioned to receive a lock interface insert configured to selectively engage a breech lock such that movement of the bolt body relative to a receiver is reduced.

In a further embodiment of any of the foregoing embodiments, the shaped cavity extends inwardly from a bottom of the bolt body.

In a further embodiment of any of the foregoing embodiments, the shaped cavity is spaced from a top of the bolt body.

In a further embodiment of any of the foregoing embodiments, the bolt body defines a pair of side openings dimensioned to access the shaped cavity. The bolt includes a pair of rails extending from sides of the bolt body. Each of the pair of rails is dimensioned to be slideably received in a corresponding channel of a barrel extension. Each of the pair of rails defines a corresponding one of the pair of side openings.

In a further embodiment of any of the foregoing embodiments, the bolt body defines a reference plane intersecting the pair of rails, and the forward cavity face and the rear cavity face are arranged such that a localized region of the shaped cavity defined by the forward cavity face and the rear cavity face is symmetrical about the reference plane.

In a further embodiment of any of the foregoing embodiments, the breech lock recess extends inwardly from a bottom of the bolt body to a recess floor bounding the breech lock recess. The recess floor is spaced from a top of the bolt body, and the recess floor is defined between the bottom of the bolt body and a reference plane defined by the cavity floor.

In a further embodiment of any of the foregoing embodiments, a cross-sectional profile of the shaped cavity is generally trapezoidal.

In a further embodiment of any of the foregoing embodiments, the forward angle is substantially equal to the rear angle.

A bolt assembly for a firearm according to an example of the present disclosure includes a bolt defining a shaped cavity and a breech lock recess. The bolt has a bolt body having a shaped cavity extending inwardly from a bottom of the bolt body, and a lock interface insert configured to be at least partially insertable into the shaped cavity. The lock interface insert has a main body defining a first engagement surface and a second engagement surface. At least one of the first engagement and second engagement surfaces is configured to engage a portion of a breech lock selectively received within the breech lock recess.

In a further embodiment of any of the foregoing embodiments, the lock interface insert and the shaped cavity are dimensioned to form an interference fit to minimize relative movement between the lock interface insert and the bolt body.

In a further embodiment of any of the foregoing embodiments, each of the at least one of the first engagement and second engagement surfaces is configured to selectively engage the portion of the breech lock.

In a further embodiment of any of the foregoing embodiments, the lock interface insert includes a pair of outward guides sized to form a flush and continuous surface with a pair of rails of the bolt.

A method of fabricating a bolt for a firearm according to an example of the present disclosure includes the steps of providing a bolt that has a bolt body extending between first and second bolt ends, and defining a shaped cavity and a breech lock recess in the bolt bod. The shaped cavity is defined by a cavity floor extending between a forward cavity face and a rear cavity face. The forward cavity face defines a forward angle relative to the cavity floor. The rear cavity face defines a rear angle relative to the cavity floor, and each of the forward angle and the rear angle is acute.

In a further embodiment of any of the foregoing embodiments, the shaped cavity is dimensioned to receive a lock interface insert configured to engage a breech lock selectively received in the breech lock recess such that movement of the bolt body relative to a receiver is reduced.

In a further embodiment of any of the foregoing embodiments, a cross-sectional profile of the shaped cavity is trapezoidal.

In a further embodiment of any of the foregoing embodiments, the forward angle is equal to the rear angle.

In a further embodiment of any of the foregoing embodiments, the bolt body defines a reference plane intersecting opposed sides of the bolt body, and the forward cavity face and the rear cavity face are arranged such a localized region of the shaped cavity defined by the forward cavity face and the rear cavity face is symmetrical about the reference plane.

In a further embodiment of any of the foregoing embodiments, the step of defining the shaped cavity and the breech lock recess includes removing material adjacent to an engagement surface of the bolt body to define the shaped cavity. The engagement surface defines the breech lock recess.

In a further embodiment of any of the foregoing embodiments, the bolt body defines a pair of side openings dimensioned to access the shaped cavity. The bolt includes a pair of rails extending from sides of the bolt body. Each of the pair of rails is dimensioned to be slideably received in a corresponding channel of a barrel extension, and each of the pair of rails defines a corresponding one of the pair of side openings.

These and other features disclosed herein can be best understood from the following specification and drawings, the following of which is a brief description.

DETAILED DESCRIPTION

Figure 1:
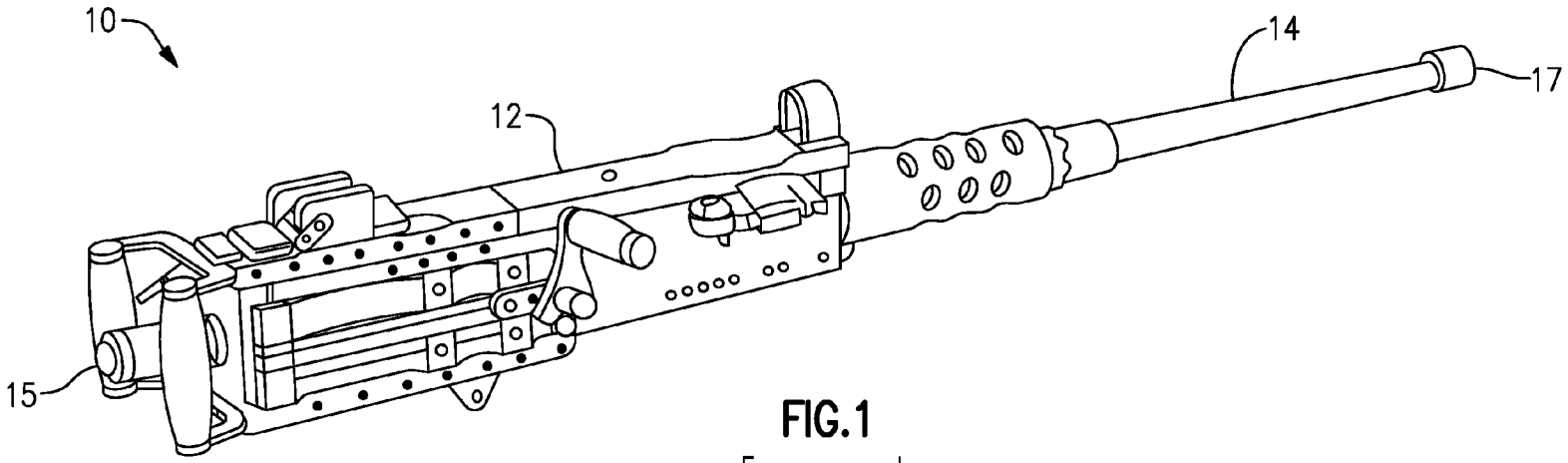
FIG. 1 Prior Art
FIG. 1 is a perspective view of a prior art machine gun.

FIG. 1 illustrates a perspective view of prior art machine gun 10, and more particularly an M2 0.50 caliber machine gun. The machine gun 10 includes a receiver 12 disposed at a first weapon end 15 and a barrel 14 disposed at a second weapon end 17. The receiver 12 includes a chamber 13 for receiving a bolt and a barrel extension 16 (shown in FIG. 3). The components of the machine gun 10 are well known.

Figure 2:
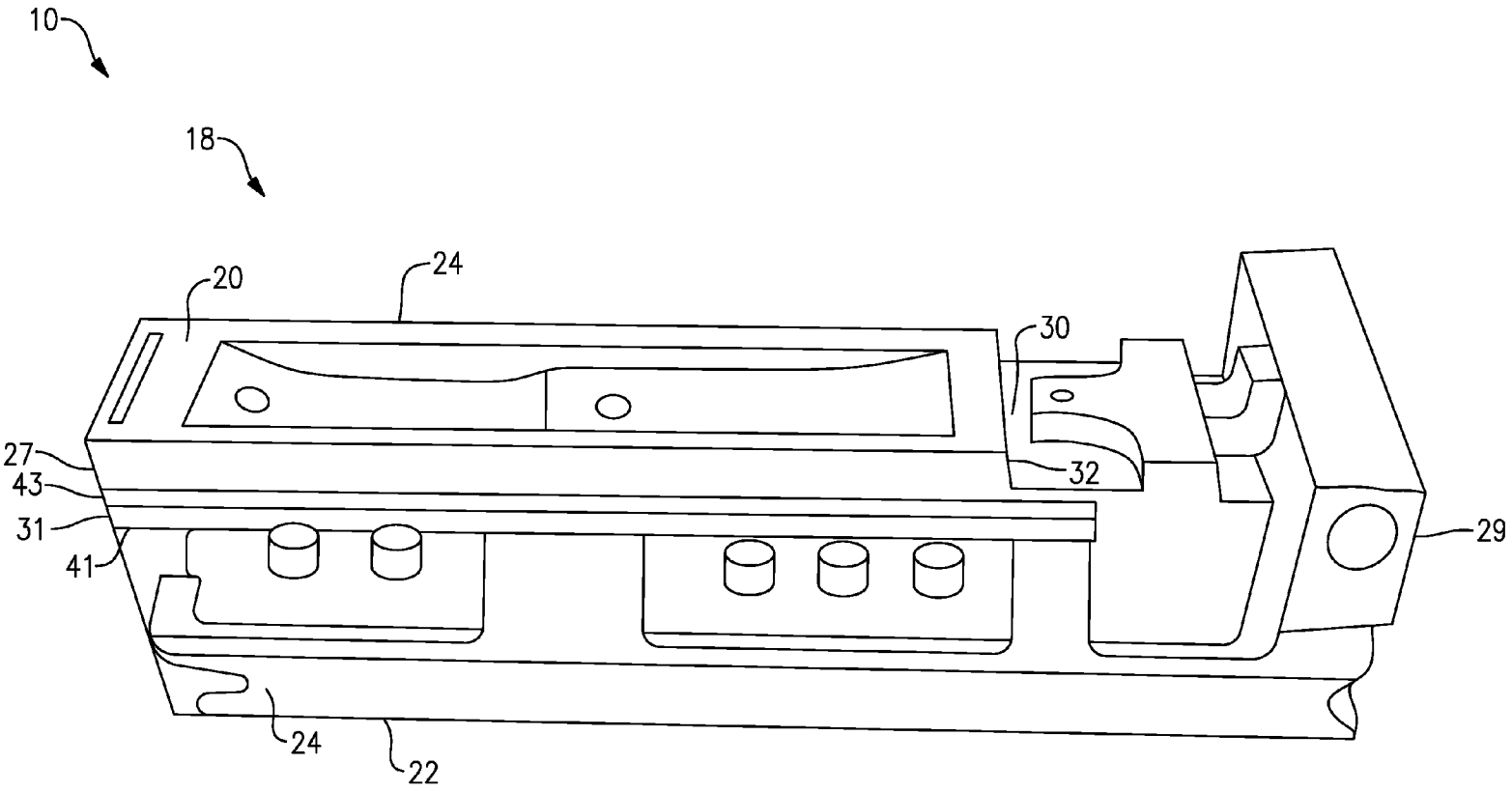
FIG.2 Prior Art
FIG. 2 is a bottom view of a bolt of the prior art machine gun of FIG. 1.

FIG. 2 illustrates a bottom view of a bolt 18 of a prior art machine gun 10. The prior art bolt 18 includes a first bolt end 27 and a second bolt end 29. The bolt 18 is configured to be partially received in a barrel extension 16 (not shown). The bolt 18 includes a pair of rails 31 extending outward from a pair of lateral sides 24 between the first and second bolt ends 27, 29. The rails 31 include an upper surface 41 and a lower surface 43 each parallel to a bottom 20 and a top 22 of the bolt 18. The rails 31 are configured to be slideably received in a pair of corresponding channels of the barrel extension 16 (not shown). The bolt 18 also defines a breech lock recess 30 extending inward from the bottom 20 of the bolt 18 for receiving a breech lock 26 (shown in FIG. 3).

Figure 3:
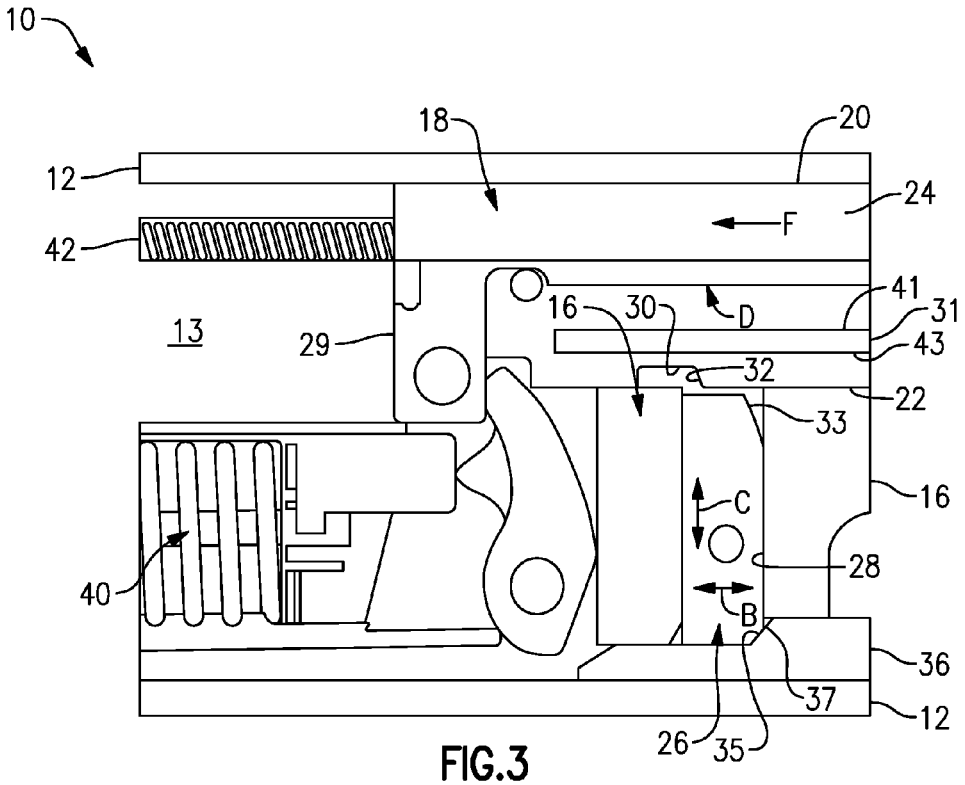
FIG.3 Prior Art
FIG. 3 is a partial side view of the bolt of the prior art machine gun of FIG. 1, the bolt in an installed and unlocked position.

FIG. 3 illustrates a partial side view of the bolt 18 and barrel extension 16 installed in the receiver 12. The breech lock 26 is disposed within an inner cavity 28 defined by the barrel extension 16. The breech lock 26 is free to move within the inner cavity 28 in a direction C. A receiver 12 includes a ramp 36 with a breech lock cam 37 for engaging a locking cam 35 of the breech lock 26. During counter-recoil, the barrel extension 16 moves in a direction B with respect to the ramp 36, causing the breech lock 26 to engage the breech lock cam 37. The breech lock 26 extends upward in the direction C toward the breech lock recess 30. The breech lock 26 engages the lock interface 32 of the bolt 18 adjacent to the breech lock recess 30, causing the bolt 18 and the barrel extension 16 to lock together.

Figure 4:
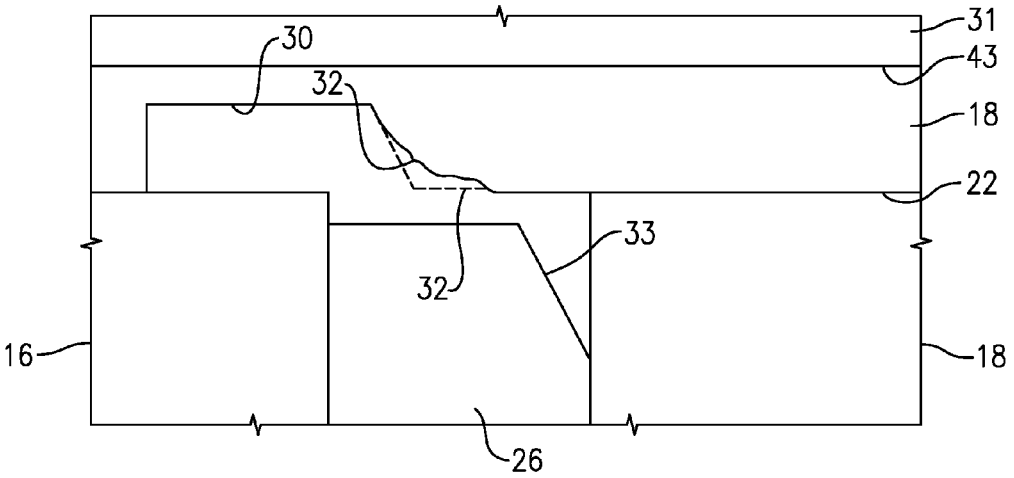
FIG. 4 is a partial side view of a worn surface of the bolt of the prior art machine gun of FIG. 3.

When the machine gun 10 is fired, a portion of a recoil force F is absorbed by a barrel buffer spring 40 and a driving rod spring 42. However, a significant amount of the recoil force F is communicated to the lock interface 32 while the bolt 18 is locked to the barrel extension 16 by the breech lock 26. Additionally, the recoil force F causes the bolt 18 to be driven in a slightly diagonal direction D along a bolt engagement surface 33 of the breech lock 26 when the bolt 18 and the barrel extension 16 are locked together. Accordingly, the lock interface 32 begins to wear as the machine gun 10 fires (shown in FIG. 4). After the amount of wear of the lock interface 32 exceeds a certain threshold, the operation of the machine gun 10 becomes unreliable. The operation of the machine gun 10 is well known.

Figure 5:
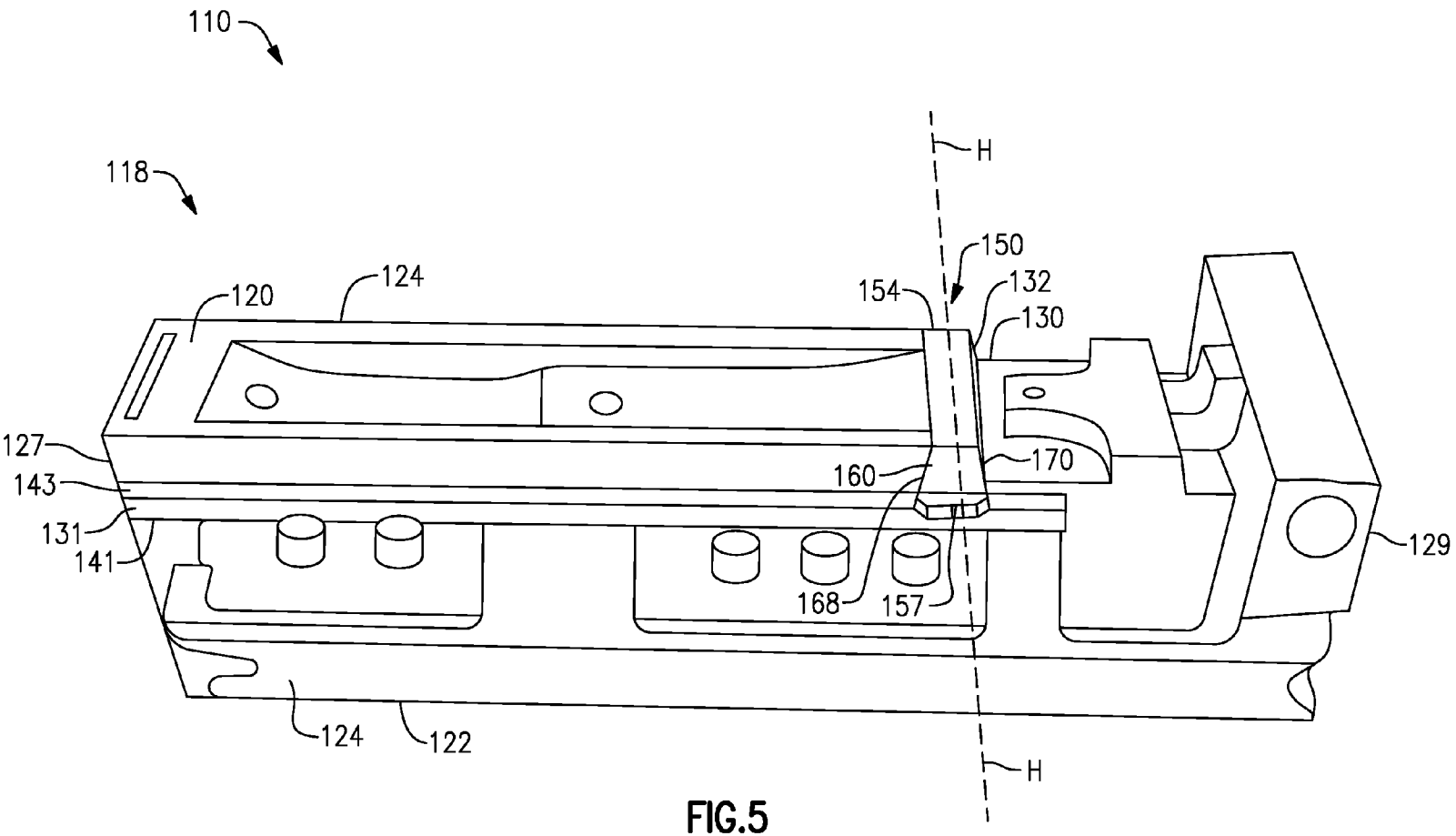
FIG. 5 is a bottom view of a lock interface insert installed in a bolt.
Figure 6:
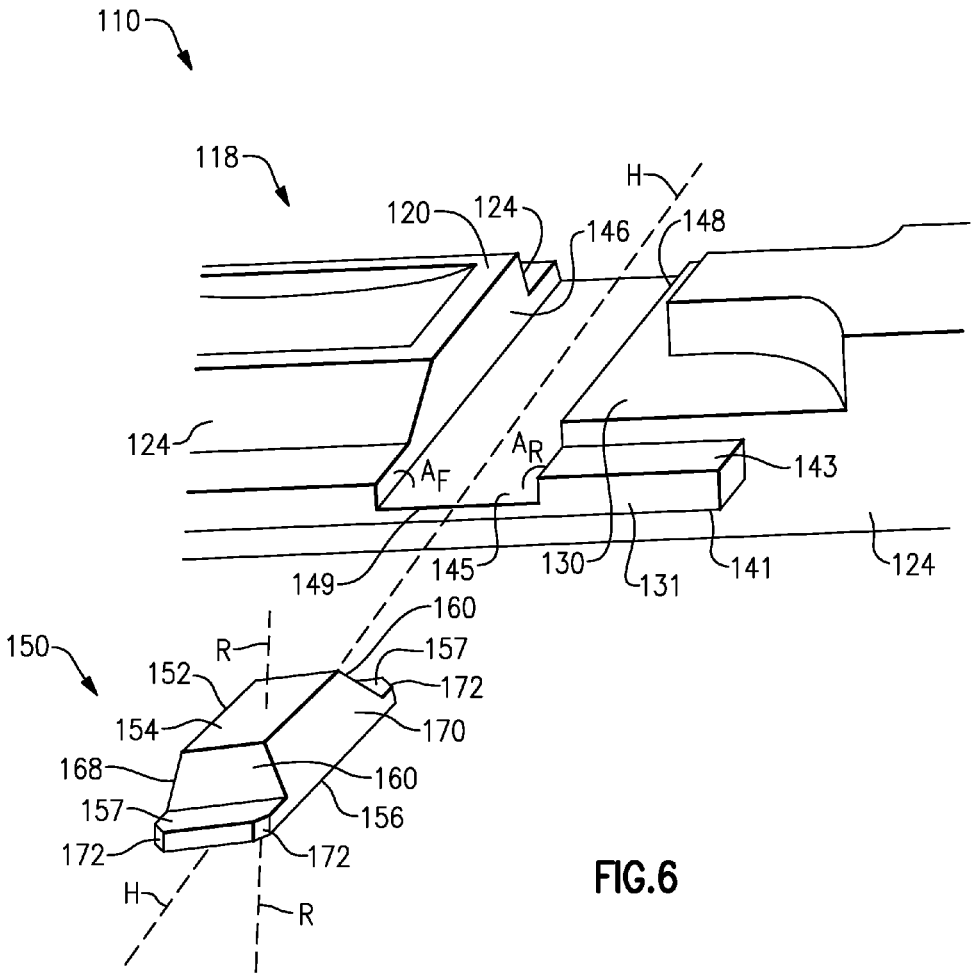
FIG. 6 is a perspective view of the bolt and the lock interface insert of FIG. 5 in an uninstalled position.

FIG. 5 illustrates a bottom view of a bolt 118 and a lock interface insert 150 in an installed position. FIG. 6 illustrates a bottom perspective view of a portion of the bolt 118 and the lock interface insert 150 of FIG. 5 with the lock interface insert 150 in an uninstalled position. In this disclosure, like reference numerals designate like elements where appropriate and reference numerals with the addition of one-hundred or multiples thereof designate modified elements that are understood to incorporate the same features and benefits of the corresponding original elements.

As shown in FIG. 6, the bolt 118 defines a shaped cavity 145 for receiving a portion of the lock interface insert 150. The shaped cavity 145 extends between a forward surface 146 and a rear surface 148 of the bolt 118 along a horizontal axis H and adjacent to the breech lock recess 130. The forward surface 146 defines a forward angle $A_F$ and the rear surface 148 defines a rear angle $A_R$ with respect to a floor 149 of the shaped cavity 145. Each of the angles $A_F$, $A_R$ is generally acute. The floor 149 extends at least partially between the upper and lower surfaces 141, 143 of the rails 131, which serve to guide the bolt's 118 movement with respect to the barrel extension 16.

The lock interface insert 150 includes a main body 152. The main body 152 includes a first insert surface 154 configured to form a flush and continuous surface with the bottom 20 the bolt 118 (shown in FIG. 5) to engage the receiver 12. The main body 152 includes a second insert surface 156 substantially parallel to the first insert surface 154 and adjacent to the floor 149 of the bolt 118 when the lock interface insert 150 is placed within the shaped cavity 145. The main body 152 includes a pair of first sides 160 opposite each other and adjacent to the first and second insert surfaces 154, 156. The first sides 160 are configured to form a flush and continuous surface with the lateral sides 124 of the bolt 118 (shown in FIG. 5).

The main body 152 includes a front engagement surface 168 and a rear engagement surface 170 opposite each other for selectively engaging the breech lock 26. The front and rear engagement surfaces 168, 170 are disposed between the first and second insert surfaces 154, 156. The front engagement surface 168 is generally oriented at the forward angle $A_F$ and the rear engagement surface 170 is generally oriented at the rear angle $A_R$ with respect to the second insert surface 156. The front engagement surface 168 is configured to be substantially parallel to the forward surface 146 of the bolt 118, and the rear engagement surface 170 is configured to be substantially parallel to the rear surface 148 of the bolt 118. The rear engagement surface 170 may be configured to be substantially parallel to the bolt engagement surface 33 to redirect a portion of the recoil force F (shown in FIG. 3) perpendicularly from the rear engagement surface 170 and into the bolt engagement surface 33 of the breech lock 26.

As shown in FIG. 5, a cross section of the lock interface insert 150 is generally trapezoidal. The forward and rear angles $A_F$, $A_R$ of the shaped cavity 145 may be substantially equal to each other and generally acute. This allows the lock interface insert 150 to be held captive in the shaped cavity 145 by the forward and rear surfaces 146, 148 of the bolt 118 and minimizes the possibility that the lock interface insert 150 may become dislodged during operation of the machine gun 110. As shown in FIG. 6, the lock interface insert 150 is symmetrical along the horizontal axis H and can be inserted into the shaped cavity 145 with either the front or rear engagement surfaces 168, 170 facing the breech lock 26. However, other shapes and configurations of the lock interface insert 150 are contemplated.

The lock interface insert 150 includes a pair of outward guides 157 extending outward from the main body 152 along the horizontal axis H. The outward guides 157 are adjacent to the second insert surface 156 of the main body 152 and form a flush and continuous surface with the rails 131 of the bolt 118 when the lock interface insert 150 is installed in the shaped cavity 145. Each of the outward guides 157 may include a pair of bevels 172 for realigning the lock interface insert 150 within the shaped cavity 145 along the horizontal axis H. Realignment occurs by engagement of the bevels 172 with an interior surface of the corresponding channels (not shown) of the barrel extension 16. The bevels 172 also facilitate the insertion of the lock interface insert 150 into the shaped cavity 145. The outward guides 157 may be integrally formed with the main body 152.

The shaped cavity 145 and the lock interface insert 150 may be configured to form an interference fit when lock interface insert 150 is slide fitted along the horizontal axis H. Accordingly, no fasteners are required to secure the lock interface insert 150 within the shaped cavity 145. The outward guides 157 also keep the lock interface insert 150 locked in place.

The lock interface insert 150 can be formed by machining, forging, casting or other methods depending on materials used and fitting specifications. The lock interface insert 150 may be formed from a second material including steel, alloy or other metals depending on military specifications and other requirements. The second material of the lock interface insert 150 may have a greater hardness than a first material of the bolt 118. The second material of the lock interface insert 150 may also be different from the first material of the bolt 118 in metallurgy. Forming the bolt 118 and the lock interface insert 150 from different materials allows each of the components to be separately optimized according to performance requirements, cost and other parameters.

Installation of the lock interface insert 150 is as follows. A portion of the prior art bolt 18 adjacent to the lock interface 32 (shown in FIGS. 2-4) is removed to define the shaped cavity 145 (shown in FIG. 5). Removal of the portion of the prior art bolt 18 may be performed by methods generally known in the art including machining In another embodiment, the shaped cavity 145 is formed during the manufacturing process. Thereafter, the lock interface insert 150 is inserted into the shaped cavity 145 along the horizontal axis H. The lock interface insert 150 may be press fit into the shaped cavity 145 with a conventional insertion tool (not shown).

When the rear engagement surface 170 wears beyond the predetermined wear threshold, the operator may reverse the orientation of the lock interface insert 150 by removing the lock interface insert 150 from the shaped cavity 145, rotating the lock interface insert 150 about a rotational axis R (shown in FIG. 6), and reinserting the lock interface insert 150 into the shaped cavity 145 with the front engagement surface 168 adjacent to the breech lock 26 (shown in FIG. 5). In this way, the advantage of a lock interface insert feature may be extended. Additionally, a sufficient amount of the rear engagement surface 170 is configured to extend below the breech lock recess 130 (shown in FIG. 5) even though a portion of the surface 170 is worn. The remaining portion of the rear engagement surface 170 is able to contact the forward surface 146 of the bolt 118 when the lock interface insert 150 is rotated to retain the lock interface insert 150 within the shaped cavity 145. The operator may discard the lock interface insert 150 to be replaced by another lock interface insert once both the front and rear engagement surfaces 168, 170 are worn.

Accordingly, the lock interface insert 150 provides several benefits over the prior art bolt 18. Only the lock interface insert 150 is discarded after the surfaces 168, 170 are worn beyond a predetermined wear threshold rather than the entire bolt 18. The bolt 118 is field repairable by replacement of the lock interface insert 150. Accordingly, a lower quantity of bolts may be kept in inventory and the repair time of the bolt is reduced. Additionally, the front and rear engagement surfaces 168, 170 of the lock interface insert 150 provide two separate wear surfaces, prolonging the duration between servicing of the bolt 118.

Although the different embodiments have the specific components shown in the illustrations, embodiments of this disclosure are not limited to those particular combinations. It is possible to use some of the components or features from one of the embodiments in combination with features or components from another one of the embodiments.

The preceding description is exemplary rather than limiting in nature. Variations and modifications to the disclosed embodiments may become apparent to those skilled in the art that do not necessarily depart from the essence of this disclosure. The scope of legal protection given to this disclosure can only be determined by studying the following claims.

What is claimed is:

1. A bolt for a firearm comprising:

a bolt body extending between a first bolt end and a second bolt end, the bolt body defining a shaped cavity adjacent to a breech lock recess;

wherein the shaped cavity is defined by a cavity floor extending between a forward cavity face and a rear cavity face, the forward cavity face defines a forward angle relative to the cavity floor, the rear cavity face defines a rear angle relative to the cavity floor, and each of the forward angle and the rear angle is acute.

2. The bolt as recited in claim 1, wherein the shaped cavity is dimensioned to receive a lock interface insert configured to selectively engage a breech lock such that movement of the bolt body relative to a receiver is reduced.

3. The bolt as recited in claim 2, wherein the shaped cavity extends inwardly from a bottom of the bolt body.

4. The bolt as recited in claim 3, wherein the shaped cavity is spaced from a top of the bolt body.

5. The bolt as recited in claim 3, wherein the bolt body defines a pair of side openings dimensioned to access the shaped cavity, the bolt includes a pair of rails extending from sides of the bolt body, each of the pair of rails dimensioned to be slideably received in a corresponding channel of a barrel extension, and each of the pair of rails defines a corresponding one of the pair of side openings.

6. The bolt as recited in claim 5, wherein the bolt body defines a reference plane intersecting the pair of rails, and the forward cavity face and the rear cavity face are arranged such that a localized region of the shaped cavity defined by the forward cavity face and the rear cavity face is symmetrical about the reference plane.

7. The bolt as recited in claim 1, wherein the breech lock recess extends inwardly from a bottom of the bolt body to a recess floor bounding the breech lock recess, the recess floor being spaced from a top of the bolt body, and the recess floor is defined between the bottom of the bolt body and a reference plane defined by the cavity floor.

8. The bolt as recited in claim 1, wherein a cross-sectional profile of the shaped cavity is generally trapezoidal.

9. The bolt as recited in claim 8, wherein the forward angle is substantially equal to the rear angle.

10. A bolt assembly for a firearm comprising:

a bolt defining a shaped cavity and a breech lock recess;

the bolt including a bolt body having a shaped cavity extending inwardly from a bottom of the bolt body;

a lock interface insert configured to be at least partially insertable into the shaped cavity, the lock interface insert including a main body defining a first engagement surface and a second engagement surface, wherein at least one of the first engagement and second engagement surfaces is configured to engage a portion of a breech lock selectively received within the breech lock recess;

wherein each of the at least one of the first engagement and second engagement surfaces is configured to selectively engage a single localized bolt engagement surface defined by the portion of the breech lock.

11. The bolt assembly as recited in claim 10, wherein the lock interface insert and the shaped cavity are dimensioned to form an interference fit to minimize relative movement between the lock interface insert and the bolt body.

12. The bolt assembly as recited in claim 10, wherein the lock interface insert includes a pair of outward guides sized to form a flush and continuous surface with a pair of rails of the bolt.

13. A method of fabricating a bolt for a firearm comprising the steps of:

providing a bolt including a bolt body extending between first and second bolt ends;

defining a shaped cavity and a breech lock recess in the bolt body; and wherein the shaped cavity is defined by a cavity floor extending between a forward cavity face and a rear cavity face, the forward cavity face defines a forward angle relative to the cavity floor, the rear cavity face defines a rear angle relative to the cavity floor, and each of the forward angle and the rear angle is acute.

14. The method as recited in claim 13, wherein the shaped cavity is dimensioned to receive a lock interface insert configured to engage a breech lock selectively received in the breech lock recess such that movement of the bolt body relative to a receiver is reduced.

15. The method as recited in claim 13, wherein a cross-sectional profile of the shaped cavity is trapezoidal.

16. The method as recited in claim 13, wherein the forward angle is equal to the rear angle.

17. The method as recited in claim 16, wherein the bolt body defines a reference plane intersecting opposed sides of the bolt body, and the forward cavity face and the rear cavity face are arranged such a localized region of the shaped cavity defined by the forward cavity face and the rear cavity face is symmetrical about the reference plane.

18. The method as recited in claim 13, wherein the step of defining the shaped cavity and the breech lock recess includes removing material adjacent to an engagement surface of the bolt body to define the shaped cavity, the engagement surface defining the breech lock recess.

19. The method as recited in claim 13, wherein the bolt body defines a pair of side openings dimensioned to access the shaped cavity, the bolt includes a pair of rails extending from sides of the bolt body, each of the pair of rails dimensioned to be slideably received in a corresponding channel of a barrel extension, and each of the pair of rails defines a corresponding one of the pair of side openings.

* * * * *